US006089961A

United States Patent [19]

Cesna et al.

[11] Patent Number: 6,089,961

[45] Date of Patent: Jul. 18, 2000

[54] WAFER POLISHING CARRIER AND RING EXTENSION THEREFOR

[75] Inventors: Joseph V. Cesna, Niles, Ill.; Inki Kim, Tempe, Ariz.

[73] Assignee: Speedfam-IPEC Corporation, Chandler, Ariz.

[21] Appl. No.: 09/206,129

[22] Filed: Dec. 7, 1998

[51] Int. Cl.[7] ..... B24B 5/00; B24B 29/00

[52] U.S. Cl. ..... 451/285; 451/287; 451/288

[58] Field of Search ..... 451/41, 259, 270, 451/271, 285, 287, 288, 289, 290, 364, 397, 398, 402, 415, 442

[56] References Cited

U.S. PATENT DOCUMENTS

| | | |
|---|---|---|
| 2,826,009 | 3/1958 | Shurson . |
| 2,883,802 | 4/1959 | Katzke . |
| 3,090,169 | 5/1963 | Boettcher . |
| 3,375,614 | 4/1968 | Boryyvhrt et al. . |
| 3,377,750 | 4/1968 | Day . |
| 3,568,371 | 3/1971 | Day et al. . |
| 4,519,168 | 5/1985 | Cesna . |
| 4,739,589 | 4/1988 | Brehm et al. . |
| 5,032,203 | 7/1991 | Doy et al. . |
| 5,177,908 | 1/1993 | Tuttle . |
| 5,205,082 | 4/1993 | Shendon et al. . |
| 5,216,843 | 6/1993 | Breivogel et al. . |
| 5,329,732 | 7/1994 | Karlsrud et al. . |
| 5,597,346 | 1/1997 | Hempel, Jr. . |
| 5,695,392 | 12/1997 | Kim . |

FOREIGN PATENT DOCUMENTS

| | | |
|---|---|---|
| 2224994 | 10/1974 | France . |

*Primary Examiner*—Derris Holt Banks
*Attorney, Agent, or Firm*—Fitch, Even, Tabin & Flannery

[57] ABSTRACT

A ring extension is provided for use with a semiconductor wafer carrier. The ring extension has a radially inner surface, the lower portion of which contacts a peripheral edge of a wafer to confine the wafer during a polishing operation. A recess or groove is formed in the inner surface and a passageway extending through the ring extension provides pressure relief to prevent slurry build up.

11 Claims, 3 Drawing Sheets

WAFER POLISHING CARRIER AND RING EXTENSION THEREFOR

BACKGROUND OF THE INVENTION

1. Field of the Invention

The present invention pertains to polishing of thin flexible workpieces, such as semiconductor wafers, and in particular to carriers used to support the wafers during chemical/mechanical polishing.

2. Description of the Related Art

It is important during chemical/mechanical polishing operations that the slurry have a uniform effect on the semiconductor wafer, during a processing cycle. It has been observed that slurry tends to build up in the region where the wafer peripheral edge, ring extension and carrier plate meet. Elaborate precautions are taken in designing carriers and slurry compositions to ensure the continual flow of slurry about a wafer. This is important, in part, because the abrasive particles within the slurry are "worn down" over prolonged use, and also because of temperature variations (local "hot spots"). It is important that these slurry-related parameters remain uniform throughout all portions of a wafer, during an ongoing polishing operation. Careful inspection of wafer polishing operations indicates that slurry flow is markedly slowed and at times even stagnated in a "build-up" region where the wafer peripheral edge, ring extension and carrier back-up plate meet. In order to better control polishing operations, advances are being sought to remedy slurry stagnation.

Wafer carrier assemblies of the type to which the present invention is directed include a backing plate member having a central protruding portion which provides backing support for the wafer, and an outer surrounding ring mounting portion which is recessed away from the wafer surface. Ring extensions, typically in the form of a band of material having a vertically elongated cross-section, are secured at their upper end to the ring mounting portion of a backing member. The lower free end of the ring extension is aligned with the cross-sectional mid-plane of the wafer or a point slightly therebelow, but yet spaced above the surface of the polishing table.

In order to provide a commercially practical precision alignment of the ring extension with respect to the wafer, the ring extension is undersized so as to have a reduced cross-sectional height, and the amount of undersizing is made up with one or more annular shims positioned between the upper end of the ring extension and the mounting portion of the backing member. In the past, under certain polishing conditions, slurry was observed to migrate into the area of the shims and, on occasion, was found to gain entry between the shims, thus distorting the planarity or planar alignment of the ring extension with respect to the polishing surface. Despite the recognition of this problem, emphasis was still given to the need to provide a free slurry flow across the surface of the wafer to be polished, a concern which oftentimes outweighed the occasional shim distortion problem. Even if the entry of slurry material into the shim area is infrequent, it would be desirable to eliminate the problem altogether, if a way could be developed which would avoid impeding slurry flow across the wafer.

A similar problem has been observed when slurry builds up in the upper portion of the extension ring, between the extension ring and the backing member, at a point above and behind the wafer being polished. On occasion, downforce pressures needed for successful polishing cause slurry to become impacted between the ring extension and the backing member. Upon subsequent ingress of slurry under pressure, slurry was found to build up behind the wafer, that is, between the wafer and the backing member. Again, the problem has been observed on an irregular basis, and in general, it is preferable to assure free slurry flow across the wafer surface being polished. However, a resolution to slurry build-up behind the wafer would be desirable if an adequate solution could be found which avoids interrupting the slurry flow across the wafer being polished.

SUMMARY OF THE INVENTION

It is an object of the present invention to provide wafer carrier apparatus for supporting a wafer during chemical/mechanical polishing.

Another object of the present invention is to provide wafer carrier arrangement of the above-described type which employs a ring extension.

A further object of the present invention is to provide wafer carrier apparatus of the above-described type in which slurry flow is managed so as to be confined to the surface of the wafer being polished.

Yet another object of the present invention is to provide a ring extension which, when employed with conventional wafer carrier apparatus, eliminates slurry build-up behind a wafer, in the shim area where the ring extension is mounted to the wafer carrier backing member.

These and other objects of the present invention are provided in a ring extension for a semiconductor wafer carrier which supports the wafer during polishing, the ring extension comprising:

a ring-shaped retainer body having an inner surface, an upper end for securement to the wafer carrier, and a lower end surrounding the wafer, with the lower end having a portion of the inner surface contacting the wafer peripheral edge so as to confine wafer movement during a polishing operation;

the retainer body inner surface extending from the upper end to the lower end and including a first portion spanning the thickness of the carrier plate and a second portion protruding beyond the carrier plate for contact with the wafer peripheral edge; and the retainer body defining a recess extending away from the inner surface, the recess located laterally adjacent the wafer carrier, immediately adjacent the wafer-contacting lower end portion of the inner surface.

Further objects of the present invention are provided in a polishing carrier assembly, comprising:

a semiconductor wafer carrier having an end surface for supporting a wafer during polishing, and an outer surface extending from said end surface;

a ring-shaped retainer body at least partly surrounding said wafer carrier outer surface, said ring-shaped retainer body having an inner surface, an upper end for securement to the wafer carrier, and a lower end surrounding the wafer, with the lower end having a portion of the inner surface contacting the wafer peripheral edge so as to confine wafer movement during a polishing operation;

the retainer body inner surface extending from the upper end to the lower end and including a first portion spanning the thickness of the carrier plate and a second portion protruding beyond the carrier plate for contact with the wafer peripheral edge; and the retainer body defining a recess extending away from the inner surface, the recess located laterally adjacent the wafer carrier, immediately adjacent the wafer-contacting lower end portion of the inner surface.

DETAILED DESCRIPTION OF THE PREFERRED EMBODIMENTS

Figure 3:
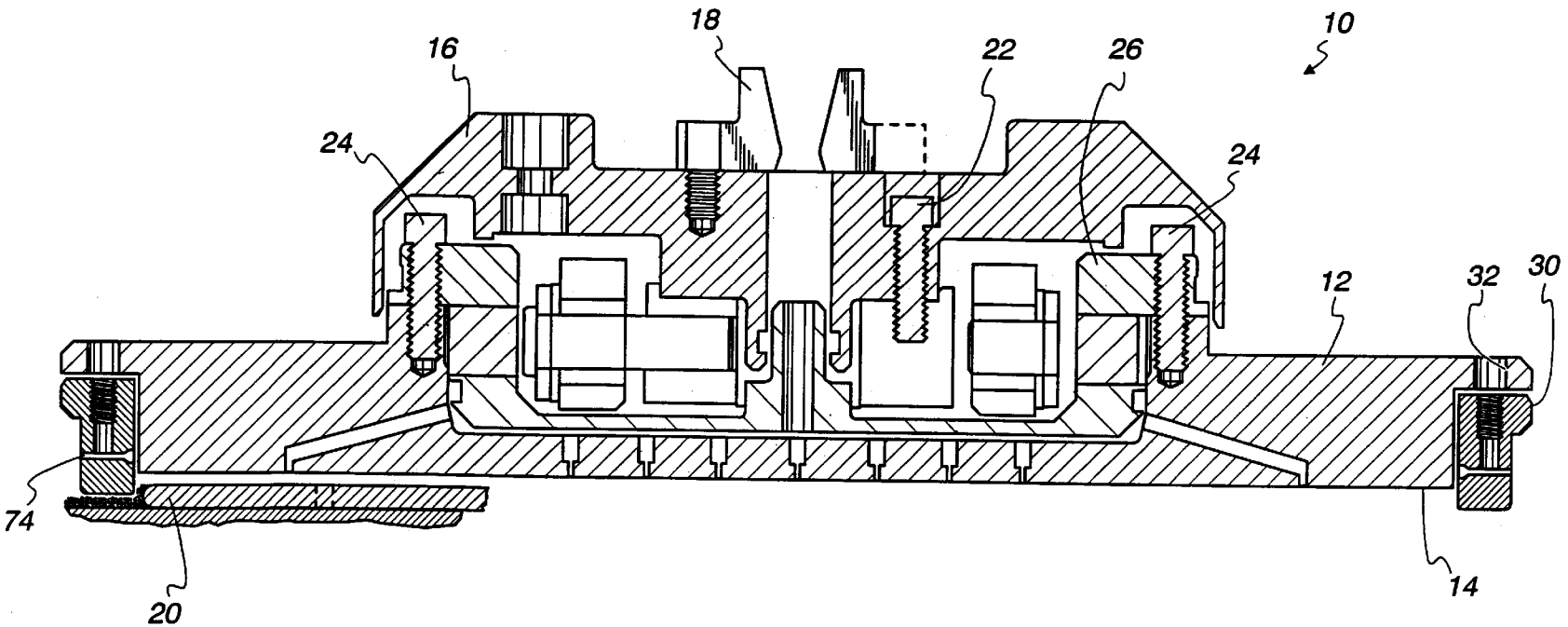
FIG. 3 shows a wafer carrier with a shim-mounted ring extension according to the principles of the present invention.

Referring now the drawings, and initially to FIG. 3, a polishing carrier assembly is generally indicated at 10. Assembly 10 provides support and downforce to a wafer 20 positioned atop a polishing surface, such as a chemical/mechanical polishing platen, a linear belt or an abrasive tape so as to polish or otherwise treat the underside surface of the wafer.

Assembly 10 includes a backing plate 12 having a bottom surface 14 pressing against the top surface of the wafer. A mounting assembly 16 provides connection at 18 to a spindle or other actuator mechanism (not shown). Mounting assembly 16 provides a gimbaled support for backing plate 12 such that the backing plate is allowed to move out of coaxial alignment with the mounting assembly as may be required during a polishing operation so as to improve polishing performance. Mounting assembly 16 is secured to backing plate 12 by a plurality of bolt fasteners 22. Bolt fasteners 24 secure an optional intermediate assembly 26 to backing plate 12. As will be seen herein, the present invention is directed to improvements in ring extensions carried by the backing plate and virtually any carrier assembly design can be employed. The ring extension of FIG. 3, indicated by the reference numeral 30, is secured to backing member 12 by threaded fasteners passing through holes 32 formed in the carrier member.

Figure 1:
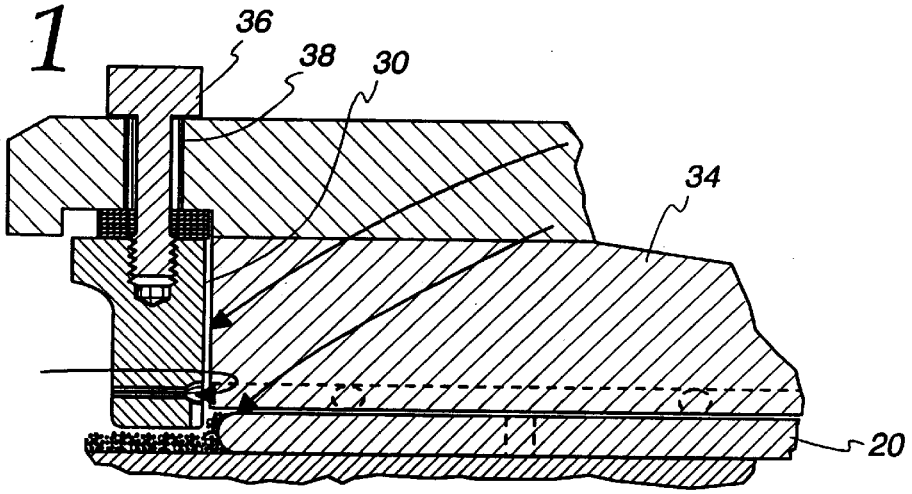
FIG. 1 is a fragmentary schematic cross-sectional view of a wafer carrier arrangement with a ring extension according to principles of the present invention.
Figure 2:
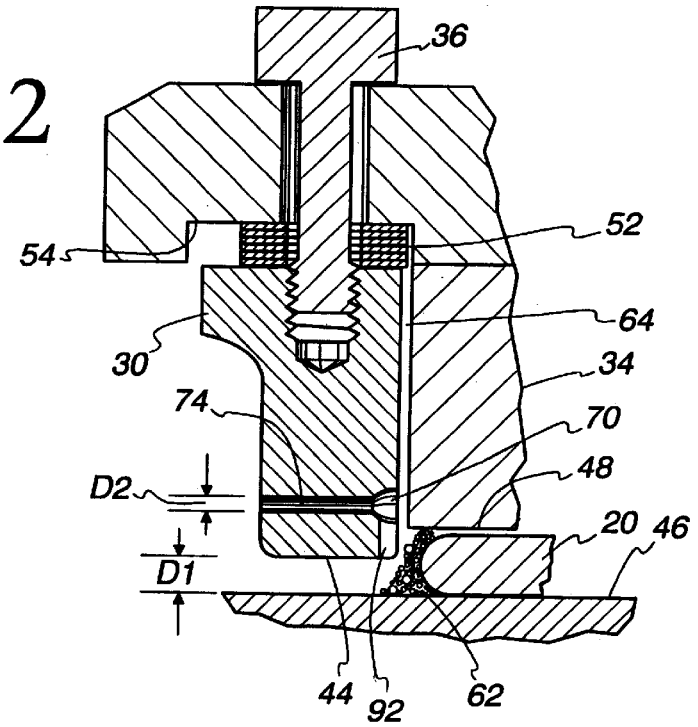
FIG. 2 shows a portion of FIG. 1 taken on an enlarged scale.

Turning now to FIGS. 1 and 2, ring extension 30 is affixed to the outer peripheral portion of backing plate 34 by bolt fasteners 36 passing through holes 38 in the backing plate. As can be seen, for example in FIG. 2, the bottom surface 44 of ring extension 30 is spaced a distance D1 above polishing surface 46. Accordingly, the bottom surface 44 of ring extension 30 extends below the bottom surface 48 of backing plate 34 by an amount less than the thickness of wafer 20. In one example, the distance D1 ranges generally between ⅓ and ½ the thickness of wafer 20. In one commercial example, the distance D1 was approximately 0.01 inch.

Turning again to FIG. 2, the distance that the bottom surface 44 of ring extension 30 extends below the bottom surface 48 of backing plate 34 is determined by one or more shims 52. Shim 52 is placed between the upper surface of ring extension 30 and an accurately machined mounting surface 54. It is generally preferred that the height of ring extension 30 be shortened so as to require a plurality of shims 52 so as to permit the addition or removal of individual shims to provide a range of adjustment of the gap D1.

Although the present invention may be employed with dry wafer-treating operations, the present invention has found immediate commercial acceptance in the field of chemical/mechanical polishing. In such operations, a liquid medium is introduced between the wafer and the polish surface. The liquid is preferably chosen to have desired chemical properties to enhance a polishing or other wafer-treating operation. Optionally, the liquid may contain abrasive particles, such as particle 62 schematically illustrated in FIG. 2.

As can be observed in FIG. 2, a small gap 64 is formed between the radially inner surface of ring extension 30 and the radially outer surface of backing pad 34. Occasionally, slurry has been observed to travel between the upper surface of the wafer and the lower surface 48 of the backing plate, thus causing distortions in the desired polishing operation. Further, slurry has at times been observed to travel along gap 64 so as to contact the shim 52. Depending upon the particular operating conditions, slurry may be introduced between the shims 52 or between the shims, backing plate surface 54, or the upper surface of the ring extension 30.

At times, packing of slurry in the area of shims 52 or behind wafer 20 (i.e., between the wafer and backing plate surface 48) caused objectionable distortions in observed polishing performance. Accordingly, a study of the problem was initiated, and resulted in improvements to retaining ring 30. As shown in FIGS. 1 and 2, an annular recess 70 is formed in the radially inner face of ring extension 30. Recess 70 preferably has a rounded cross-section, as shown, although cross-sections of other shapes, such as rectangle or triangle, can be employed as well.

In one commercial embodiment, providing polishing support for wafers having a diameter of approximately 8 inches, recess 70 ranges between 0.05 inch and 0.25 inch and most preferably between 0.06 and 0.08 inch. Preferably, the width of recess 70 ranges between ½ and 2 times the depth of the recess and, as shown in FIG. 2, most preferably has approximately the same dimensions as the recess steps. As shown in FIG. 2, recess 70 is spaced from the bottom surface 44, and the bottom edge of recess 70 is located approximately at the bottom surface 48 of backing plate 34.

It is generally preferred that the recess 70 be formed slightly above the point of contact with wafer 20 so as to avoid a sharp edge to contact with the wafer, which may damage its peripheral edge. Thus, in the preferred embodiment, recess 70 is positioned so as to acquire slurry which has just approached gap 64.

In the preferred embodiment shown, with the bottom of recess 70 approximately laterally adjacent the bottom surface 48 of backing plate 34, recess 70 is in effect interposed upstream of gap 64. The preferred arrangement allows flow release to slurry which would otherwise become trapped or impacted in the vicinity where the bottom surface 48 contacts the outer peripheral edge of wafer 20. According to principles of the present invention, the location of recess 70 relative to wafer 20 can be changed from that shown in the figures. For example, recess 70 can be moved down-wardly so as to lie partly or wholly below surface 48. Alternatively, recess 70 can be moved upwardly from the position shown in FIG. 2. Preferably, the location of recess 70 is chosen to lie in the range up and down from the position shown in FIG. 2, by an amount approximately equal to one and one-half times the recess depth.

Preferably, recess 70 forms a continuous annular ring, although, if desired, recess 70 could be formed as a series of discrete, spaced apart segments. In the commercial embodiment shown, the wafer comprises a circular disk with the wafer carrier assembly having a complementary circular top plan form. Accordingly, if recess 70 is made to comprise a series of spaced apart segments, the segments would preferably take on a part circular configuration.

In certain applications, recess 70 may alone be sufficient to prevent excessive distortions during observes polishing performance. However, from a general basis, it has been found helpful to provide one or more air holes or passageways 74 extending through the ring extension in the manner indicated in FIG. 2. Preferably, passageways 74 are formed by conventional drilling operations and, accordingly, passageway 74 is made to have a circular cross-section. Most preferably, the width or diameter D2 of passageway 74 is between two and three times the depth of recess 70. In the commercial embodiment discussed above, recess 70 has a depth of 0.06 inch with passageway 74 having a diameter of 0.125 inch.

Preferably, passageway 74, in combination with recess 70, forms a continuous opening between the radially outer face and the radially inner face of ring extension 30, so as to release any pressure (positive or negative) of the slurry that may build up adjacent the upper peripheral edge of wafer 20. Considering the polishing carrier assembly from the perspective of a bottom plan view, pressure pulses occur at different angular positions of recess 70, with the pressure regions continuously moving during a polishing operation. This is due, for example, to a lateral movement of wafer 20 with respect to ring extension 30.

As shown, for example in FIG. 2, the internal diameter of ring extension 30 is dimensioned slightly larger than wafer 20. In the commercial embodiment described above, for a nominal eight inch diameter wafer, the internal diameter of ring extension 30 is made between 1.0 and 1.5 millimeters larger than the outer diameter of the wafer. The wafer is free to move laterally during a polishing operation so as to contact different points of the ring extension, at different angular positions. Assuming observations are made at a fixed point on the ring extension, it can be seen that pressures are built up as the wafer peripheral edge approaches and then contact the ring extension. In a similar manner, as the wafer peripheral edge recedes away from the ring extension, local pressures drop.

Depending upon the composition of the slurry involved, continuously changing pressure excursions can give rise to a substantial "pumping" effect in which slurry, if not controlled, could become tightly packed behind wafer 20 and within the area of shims 52. With the present invention, however, such pressure excursions are minimized with introduction of the pneumatic circuit element formed by the cooperation of passageway 74 and recess 70. By allowing ambient air pressure to enter through passageway 74, slurry build up is more likely to ebb toward the polishing surface when localized pressure is relieved.

Figure 4:
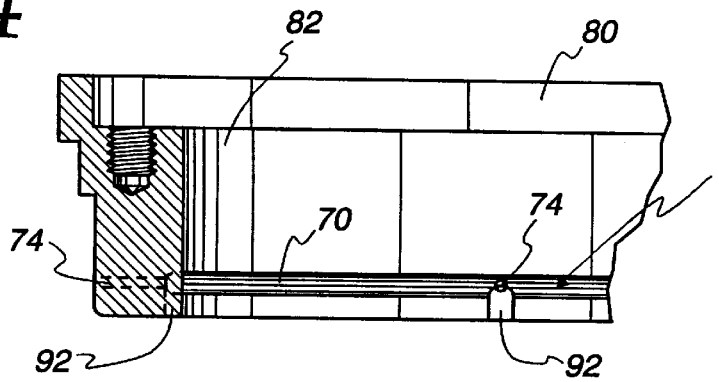
FIG. 4 shows a portion of a ring extension according to the principles of the present invention.
Figure 5:
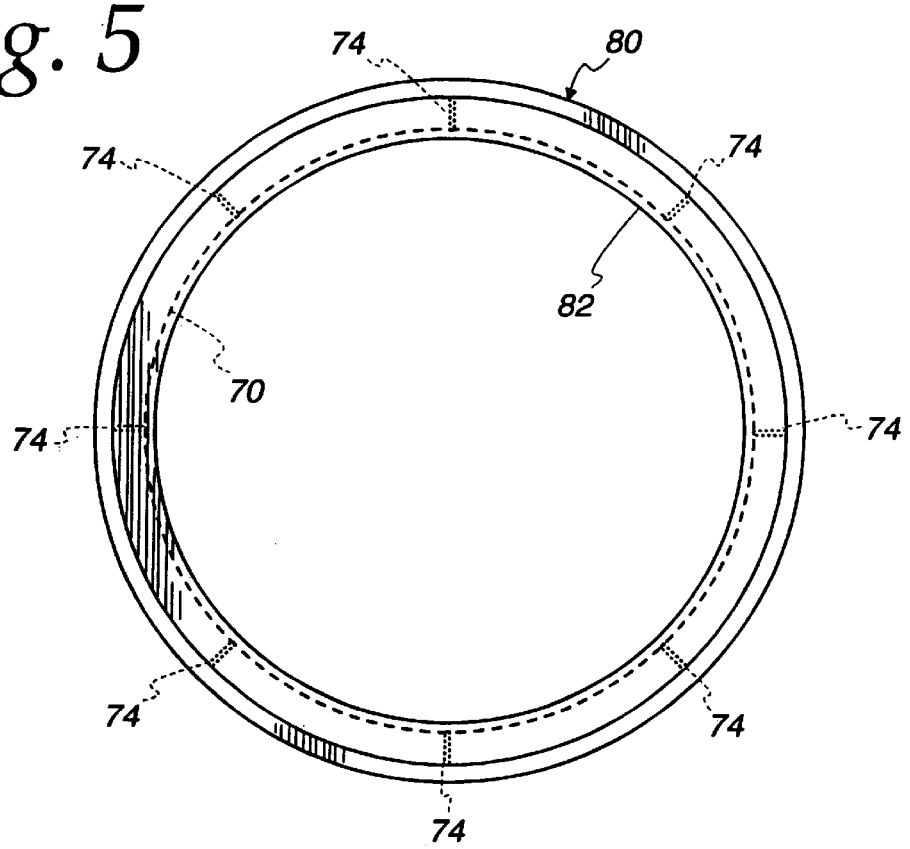
FIG. 5 is a bottom plan view of the ring extension of FIG. 4 shown on an enlarged scale.
Figure 6:
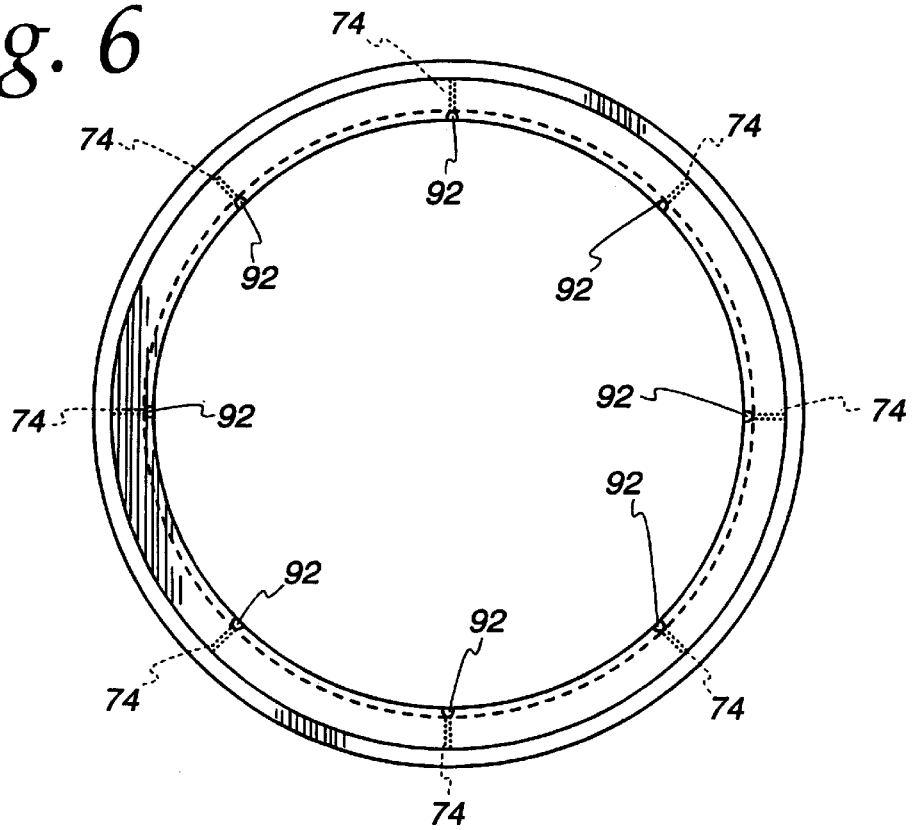
FIG. 6 is a bottom view of a ring extension similar to that of FIG. 5, but with optional drain slots.

Turning now to FIGS. 4–6, and initially to FIG. 4, a ring extension 80 has a recess 70 formed on its inner face 82, in the manner described above. As mentioned, recess 70 is preferably formed as a continuous annular ring and this is reflected in FIG. 4. It is generally preferred that the passageways 74 be formed as a series of discrete angularly spaced holes throughout or otherwise formed through the entire thickness or width of the ring extension. As shown in FIG. 5, eight passageways 74 are formed in the ring extension. In FIG. 5, the relative sizes of holes 74 and at the recess 70 are exaggerated for illustrative purposes.

Referring now to FIGS. 2, 4 and 6, optional axially extending recesses 92 may be provided for additional pressure release, or in place of holes 74. Recesses 92 extend in directions generally parallel to the central longitudinal axis of the polishing carrier assembly, i.e., usually in a vertical direction. Recesses 92 extend from the bottom surface 44 of the ring extension to the annular recess 70. Recesses 92 are preferably spaced apart, being angularly dispersed about the ring extension. As indicated in FIG. 6, when recesses 92 and holes 74 are both employed, they are preferably angularly aligned with one another. However, if desired, the holes 74 may be angularly offset with respect to the recesses 82. In the preferred mode of fabrication, recesses 92 were formed with the same tooling used to form recess 70, although different tooling having different relative sizes and cross-sectional shapes could be employed, if desired. Further variations are also possible. Although the holes 74 and recesses 92 are illustrated as formed at discrete angularly spaced apart locations, the holes and/or recesses 92 could be enlarged to form slots, each having a substantial angular dimension.

Preferably, holes 74 provide pressure relief to the recess 70 and, according, other, equivalent structures could be employed. For example, hole 74 need not extend in a horizontal direction but could, for example, extend upwardly and outwardly from the inner surface of the ring extension. Further, although it was found convenient to provide pressure relief by forming structures in the ring extension, pressure relief could also be formed as drilled holes or other passageways in the carrier backing plate.

As can be seen, for example with reference to FIG. 2, a ring extension 30 has been provided for use with a semiconductor wafer carrier which supports wafer 20 during polishing. The ring extension 30 includes a ring-shaped retainer body having an upper end adjacent shims 52 with a threaded passageway for securement to the wafer carrier and a lower end 44 which surrounds wafer 20. The lower end of ring extension 30 has a radially inner surface which contacts the wafer peripheral edge so as to confine wafer movement during the polishing operation. The radially inner surface of the ring extension has a first portion spanning the thickness of the carrier plate and a second portion protruding beyond the carrier plate which contacts the wafer peripheral edge. The extension defines a groove or recess outwardly extending from the inner surface. Preferably, the groove is located laterally adjacent the wafer carrier, at or above the lower surface 48 of the wafer carrier backing plate. Accordingly, the recess is preferably formed so as to be positioned immediately adjacent the wafer-contacting lower end portion of the ring extension inner surface.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A ring extension for a semiconductor wafer carrier having a predetermined thickness and which supports a wafer having a peripheral edge during polishing, the ring extension comprising:

a ring-shaped retainer body having an inner surface, an upper end for securement to the wafer carrier, and a lower end surrounding the wafer, with the lower end having a portion of the inner surface contacting the wafer peripheral edge so as to confine wafer movement during a polishing operation;

the retainer body inner surface extending from the upper end to the lower end and including a first portion spanning at least a portion of the thickness of the wafer carrier and a second portion protruding beyond the wafer carrier for contact with the wafer peripheral edge; and the retainer body defining a recess extending away from the inner surface, the recess located laterally adjacent the wafer carrier, immediately adjacent the wafer-contacting lower end portion of the inner surface.

2. The ring extension of claim 1 wherein said retainer body defines at least one passageway connecting the recess to an ambient surrounding environment.

3. The ring extension of claim 2 wherein said retainer body forms a plurality of spaced apart passageways communicating with said recess.

4. The ring extension of claim 2 further comprising at least one axial recess extending from the lower end of the retainer body to said recess.

5. The ring extension of claim 2 wherein said retainer body has an internal diameter of approximately eight inches, and said recess has a depth ranging between 0.05 inch and 0.23 inch.

6. A polishing carrier assembly, comprising:

a semiconductor wafer carrier having a predetermined thickness, an end surface for supporting a wafer having a peripheral edge during polishing, and an outer surface extending from said end surface;

a ring-shaped retainer body at least partly surrounding said wafer carrier outer surface, said ring-shaped retainer body having an inner surface, an upper end for securement to the wafer carrier, and a lower end surrounding the wafer, with the lower end having a portion of the inner surface contacting the wafer peripheral edge so as to confine wafer movement during a polishing operation;

the retainer body inner surface extending from the upper end to the lower end and including a first portion spanning at least a portion of the thickness of the wafer carrier and a second portion protruding beyond the wafer carrier for contact with the wafer peripheral edge; and the retainer body defining a recess extending away from the inner surface, the recess located laterally adjacent the wafer carrier, immediately adjacent the wafer-contacting lower end portion of the inner surface.

7. The polishing assembly of claim 6 wherein said retainer body defines at least one passageway connecting the recess to an ambient surrounding environment.

8. The polishing assembly of claim 7 wherein said retainer body forms a plurality of spaced apart passageways communicating with said recess.

9. The polishing assembly of claim 7 further comprising at least one axial recess extending from the lower end of the retainer body to said recess.

10. The polishing assembly of claim 7 wherein said retainer body has an internal diameter of approximately eight inches, said recess has a depth range in between 0.05 inch and 0.23 inch.

11. The polishing assembly of claim 6 wherein said semiconductor wafer carrier includes a peripheral portion overlying said retainer body and said polishing carrier assembly further comprises at least one shim between said semiconductor wafer carrier and the upper end of said retainer body.

* * * * *